US012716152B2

(12) United States Patent
Chen et al.

(10) Patent No.: US 12,716,152 B2
(45) Date of Patent: Aug. 25, 2026

(54) KNITTED FABRIC, KNITTING METHOD AND GLOVE

(71) Applicant: ZHEJIANG BAIXIANG TECHNOLOGY CO., LTD., Shaoxing (CN)

(72) Inventors: Baixiang Chen, Shaoxing (CN); Rengang Wang, Shaoxing (CN); Jianming Feng, Shaoxing (CN); Hai Li, Shaoxing (CN)

(73) Assignee: ZHEJIANG BAIXIANG TECHNOLOGY CO., LTD., Shaoxing (CN)

( * ) Notice: Subject to any disclaimer, the term of this patent is extended or adjusted under 35 U.S.C. 154(b) by 0 days.

(21) Appl. No.: 18/459,657

(22) Filed: Sep. 1, 2023

(65) Prior Publication Data

US 2025/0043471 A1 Feb. 6, 2025

(30) Foreign Application Priority Data

Jul. 31, 2023 (CN) ..... 202322045747.6

(51) Int. Cl.

*D04B 1/28* (2006.01)
*A41D 19/00* (2006.01)
*D04B 1/10* (2006.01)

(52) U.S. Cl.

CPC ..... *D04B 1/28* (2013.01); *A41D 19/00* (2013.01); *D04B 1/102* (2013.01); *A41D 2500/10* (2013.01)

(58) Field of Classification Search

CPC . D04B 1/10; D04B 1/106; D04B 1/28; D04B 1/102; D04B 7/34

See application file for complete search history.

(56) References Cited

U.S. PATENT DOCUMENTS 5,456,096 A * 10/1995 Mitsumoto ..... D04B 1/22 66/172 R
6,578,389 B1 * 6/2003 Okamoto ..... D04B 1/22 66/64
2006/0144097 A1 * 7/2006 Langer ..... D04B 1/26 66/178 R

FOREIGN PATENT DOCUMENTS

EP 2565308 A1 * 3/2013 ..... D04B 1/126
WO WO-2008009971 A2 * 1/2008 ..... D04B 1/108
WO WO-2015078817 A1 * 6/2015 ..... D04B 1/126

OTHER PUBLICATIONS

Beth Shearing. "How to knit: Intarsia knitting with several colours", [Retrieved Oct. 25, 2024] Retrieved from the Internet: <URL: https://www.theknittingnetwork.co.uk/blog/how-to-knit-intarsia-knitting-with-several-colours> (Year: 2016).*

* cited by examiner

*Primary Examiner* — Aiying Zhao
(74) *Attorney, Agent, or Firm* — Ziegler IP Law Group, LLC.

(57) ABSTRACT

A knitted fabric includes a first face and a second face which are oppositely arranged. At the edge joint between the first face and the second face, a first yarn joint is formed through the connection between the first loop of the $n^{th}$ first loop row and the first loop of the $(n+1)^{th}$ first loop row, and a second yarn joint is formed through the connection between the second loop of the $n^{th}$ second loop row and the second loop of the $(n+1)^{th}$ second loop row. The first yarn joint and the second yarn joint interlock with each other to form an interlocked part to connect the first face and the second face. Since the first and second sides are knitted independently, the needle guide carriage corresponding to the first side and the second side will always cooperate with the correspond- (Continued)

ing yarn feeder during reciprocating movement with no idle motions.

7 Claims, 11 Drawing Sheets

KNITTED FABRIC, KNITTING METHOD AND GLOVE

CROSS REFERENCE TO RELATED APPLICATIONS

This patent application claims the benefit and priority of Chinese Patent Application No. 202322045747.6 filed on Jul. 31, 2023, the disclosure of which is incorporated by reference herein in its entirety as part of the present application.

TECHNICAL FIELD

The invention relates to the technical field of knitting, in particular to a knitted fabric, and a knitting method and a glove.

BACKGROUND

Wearable items such as gloves, socks, clothes can be made of yarn, wool, leather, cloth and other materials. Wearable items knitted from yarns are widely used in various fields due to their low cost. There are many knitting ways for yarns, including knitting through flat knitting machines, jacquard machines, circular knitting machines or other equipment.

When a flat knitting machine is adopted to knit a two-piece fabric, every time the needle guide carriage moves from left to right, the knitting needle is pushed up by the raising cam on the cam plate in the back needle guide carriage and fed with a yarn from the yarn feeder, completing a knitting action; correspondingly, every time the needle guide carriage moves from right to left, the knitting needle is pushed up by the raising cam on the cam plate in the front needle guide carriage and fed with a yarn from the same yarn feeder, completing another knitting action; the reciprocating action the needle guide carriage completes from left to right and then back to the left is called completing a course, and through the continuous running in circles by the needle guide carriage, the yarn is knitted in a spiral manner; as shown in FIG. 1, the left side is a first face, and the right side is a second face. In the course knitted in a spiral manner, there are several knitting units, among which the knitting unit at the seam between the first face and the second face is no different from other knitting units.

However, there are certain defects in the structure knitted by the above-mentioned method. On the one hand, since the yarn can only be knitted in a spiral manner, the front needle guide carriage or the back needle guide carriage will have some idle motions during the completion of a course, which limits the knitting efficiency; on the other hand, the boundary between the first face and the second face of the fabric knitted by this way is not clear, and the first face and the second face cannot be stacked together flatly, resulting in the large storage volume and insufficient flatness of the stacked fabrics.

SUMMARY

Targeted at the shortcomings of the prior art, the present invention provides a knitted fabric, a knitting method and a glove, which solve the problems of low knitting efficiency and insufficient flatness after being shaped of knitted fabrics with front and back faces in the prior art.

To achieve the above-mentioned purposes, the present invention adopts the following technical solutions:

A knitted fabric, comprising a first face and a second face which are oppositely arranged, wherein the first face comprises several first loop rows connected in sequence vertically, and the first loop row each comprises several first loops connected in sequence horizontally; and the second face comprises several second loop rows connected in sequence vertically, and the second loop row each comprises several second loops connected in sequence horizontally;

at the edge joint between the first face and the second face, a first yarn joint is formed through the connection only between the first loop of the $n^{th}$ first loop row and the first loop of the $(n+1)^{th}$ first loop row, and a second yarn joint is formed through the connection only between the second loop of the $n^{th}$ second loop row and the second loop of the $(n+1)^{th}$ second loop row, and the first yarn joint and the second yarn joint interlock with each other to form an interlocked part to connect the first face and the second face.

Preferably, the first yarn joint intersects with the second yarn joint from the outside to the inside to form the interlocked part; or the first yarn joint intersects with the second yarn joint from the inside to the outside to form the interlocked part.

Preferably, the several first loop rows in the first face are knitted with a same yarn.

Preferably, the several first loop rows in the first face or the several first loop are knitted with different yarns.

Preferably, the several second loop rows in the second face are knitted with a same yarn.

Preferably, the several second loop rows in the second face or several second loop are knitted with different yarns.

Preferably, the first face and the second face are connected at both edge joints of first sides and second sides;

the $n^{th}$ first loop row in the first face and the $n^{th}$ second loop row in the second face have the interlocked part at the edge joint of the first sides, and the $(n+1)^{th}$ first loop row in the first face and the $(n+1)^{th}$ second loop row in the second face have the interlocked part at the edge joint of the second sides; or, the $n^{th}$ first loop row in the first face and the $n^{th}$ second loop row in the second face have the interlocked part at the edge joint of the second sides, and the $(n+1)^{th}$ first loop row in the first face and the $(n+1)^{th}$ second loop row in the second face have the interlocked part at the edge joint of the first sides.

To achieve the above-mentioned purposes, the present invention also adopts the following technical solutions:

A knitting method for the above-mentioned knitted fabric, comprising the following steps:

in the knitting area, a first yarn feeder follows a first needle guide carriage to move along a first direction and knit the $n^{th}$ first loop row in the first face, and a second yarn feeder follows a second needle guide carriage to move along the first direction and knit the $n^{th}$ second loop row in the second face, and the first needle guide carriage first reaches the edge joint of the first sides of the $n^{th}$ rows of the first face and the second face, and the second needle guide carriage second reaches the edge joint of the first sides of the $n^{th}$ rows of the first face and the second face; and then, the first needle guide carriage first leaves the edge joint of the first sides of the $n^{th}$ rows of the first face and the second face along a second direction, and the second needle guide carriage second leaves the edge joint of the first sides of the $n^{th}$ rows of the first face and the second face along the second direction, and the first yarn joint and the second yarn joint interlock with each other at the edge joint of the first sides of the first face and the second face to form the interlocked parts, thus connecting the first face and the second face; and then, the first yarn feeder follows the first needle guide carriage along the second direction to knit the $(n+1)^{th}$ first loop row in the first face, and the second yarn feeder follows the second needle guide carriage along the second direction to knit the $(n+1)^{th}$ second loop row in the second face; and the first direction and the second direction are parallel with and opposite to each other.

Preferably, the first face and the second face are connected at both the edge joints of the first sides and the second sides; and the knitting method further comprises:

the first needle guide carriage first reaches the edge joint of the second sides of the $(n+1)^{th}$ rows of the first face and the second face, and the second needle guide carriage second reaches the edge joint of the second sides of the $(n+1)^{th}$ rows of the first face and the second face; and then, the first needle guide carriage first leaves the edge joint of the second sides of the $(n+1)^{th}$ rows of the first face and the second face along the first direction, and the second needle guide carriage 9 second leaves the edge joint of the second sides of the $(n+1)^{th}$ rows of the first face and the second face along the first direction, and the first yarn joint and the second yarn joint interlock with each other at the edge joint of the second sides of the first face and the second face to form the interlocked parts.

To achieve the above-mentioned purposes, the present invention also adopts the following technical solutions:

A glove comprising the above-mentioned knitted fabric.

The beneficial effects of the present invention over the prior art are:

For the knitted fabric, knitting method and glove provided in the above technical solution, the knitting order do not need to be knitting the loop rows of the first face first and then knitting the loop rows of the second face as in the prior art, but instead, the first face and the second face are knitted independently, and the first face and the second face are connected to each other through the interlocked parts formed with the knitting yarn between the neighboring loop rows at the edge joint of the first face and the second face. The fabric can still be shaped, while the structure of its interlocked part is different from the structure of the first and second loops in that it is of a nested and interlocked structure, which makes it easier to form a crease at the edge joint of the first side and the second side, thus making it easier for the first side and the second side to match with each other. And if the knitted fabric needs to be in a folded state after the knitting is completed, it can be flatter in shape. And for the glove with the knitted fabric described above, the folding is formed naturally after the knitting is completed, and the glove is flatter in shape with smaller storage volume; and since the first side and the second side are knitted independently, the needle guide carriage corresponding to the first side and the second side will always cooperate with the corresponding yarn feeder during reciprocating movement with no idle motions, thus realizing a nearly doubled knitting efficiency and a substantially increased production capacity without the enhancement of the needle guide carriage's movement speed.

BRIEF DESCRIPTION OF THE DRAWINGS

In order to provide a clearer explanation of the specific embodiments of the present invention or the technical solutions in the prior art, a brief introduction will be given to the drawings required for the description of the specific embodiments or the prior art. It is evident that the drawings in the following description are some embodiments of the present invention. For those of ordinary skill in the art, other drawings can be obtained based on these drawings without any creative work.

CONNOTATIONS OF THE REFERENCE SIGNS IN THE DRAWINGS

Figure 1:
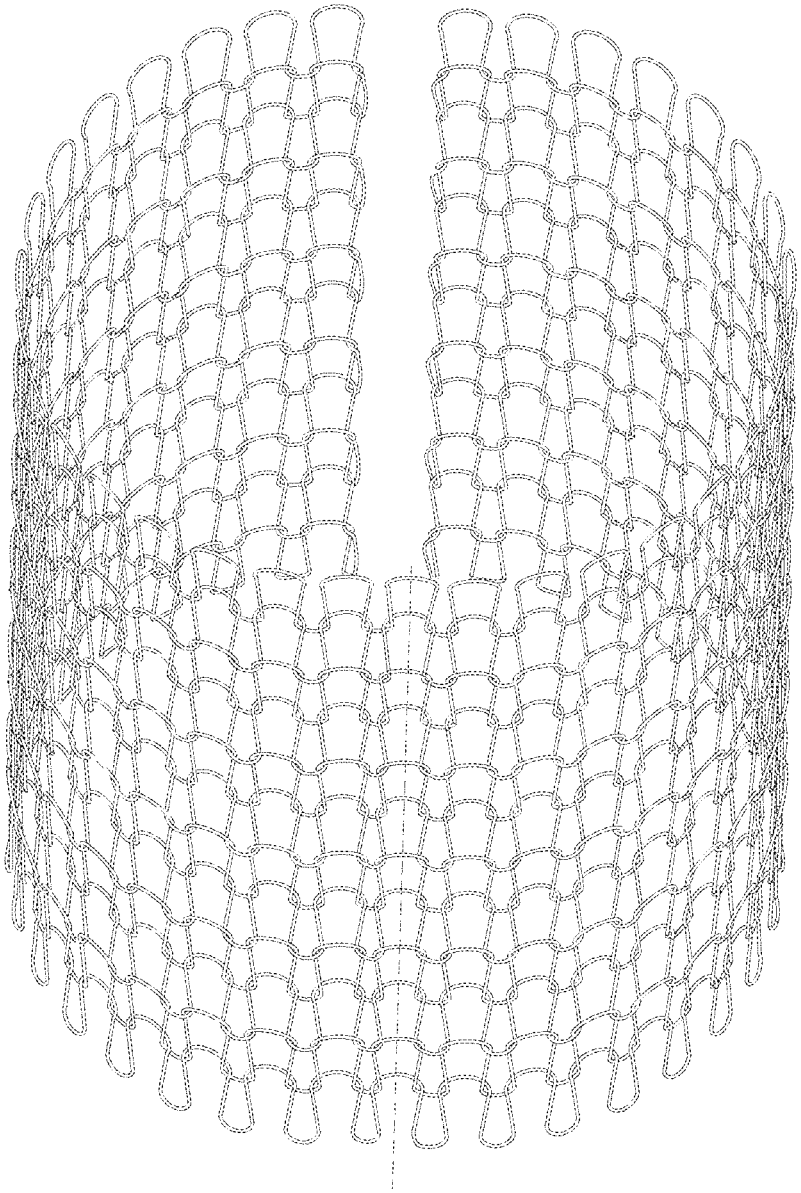
Prior Art FIG. 1
FIG. 1 is a schematic isometric view of a knitted fabric in the prior art.

1. first face; 11. first loop row; 12. first loop; 13. first yarn joint; 2. second face; 21. second loop row; 22. second loop; 23. second yarn joint; 3. first side; 4. second side; 5. interlocked part; 6. first yarn feeder; 7. first needle guide carriage; 8. second yarn feeder; 9. second needle guide carriage; 10. knitted fabric.

DETAILED DESCRIPTION OF THE EMBODIMENTS

The technical solutions of the present invention will be clearly and completely described below with the drawings. Apparently, the described embodiments are part of the embodiments of the present invention, but not all of them. Based on the embodiments of the present invention, all other embodiments obtained by persons of ordinary skill in the art without creative work belong to the protection scope of the present invention.

In the description of the present invention, it should be noted that the indicated orientation or positional relationship described by the terms "center", "upper", "lower", "left", "right", "vertical", "horizontal", "inner", "outer" and the like is based on the orientation or positional relationship shown in the drawings, which is only for describing the present invention more easily and simplifying the description, rather than indicating or implying that the referred device or element must have a specific orientation, or must be constructed or operated in a specific orientation, therefore, such description should not be construed as limits for the invention. In addition, the terms such as "first", "second", and "third" are used for descriptive purposes only, and should not be construed as indicating or implying relative importance.

In the description of the present invention, it should be noted that unless otherwise specified or defined, the terms such as "installation", "in connection with" and "connection" should be understood in a broad sense, for example, it can be a fixed connection, a detachable connection or an integral connection; it can be mechanically connected, or electrically connected; and it can be directly connected, or indirectly connected through a medium; and it can be the internal communication of two components. Those of ordinary skill in the art can understand the specific meanings of the above terms in the present invention as per specific situations.

Figure 2:
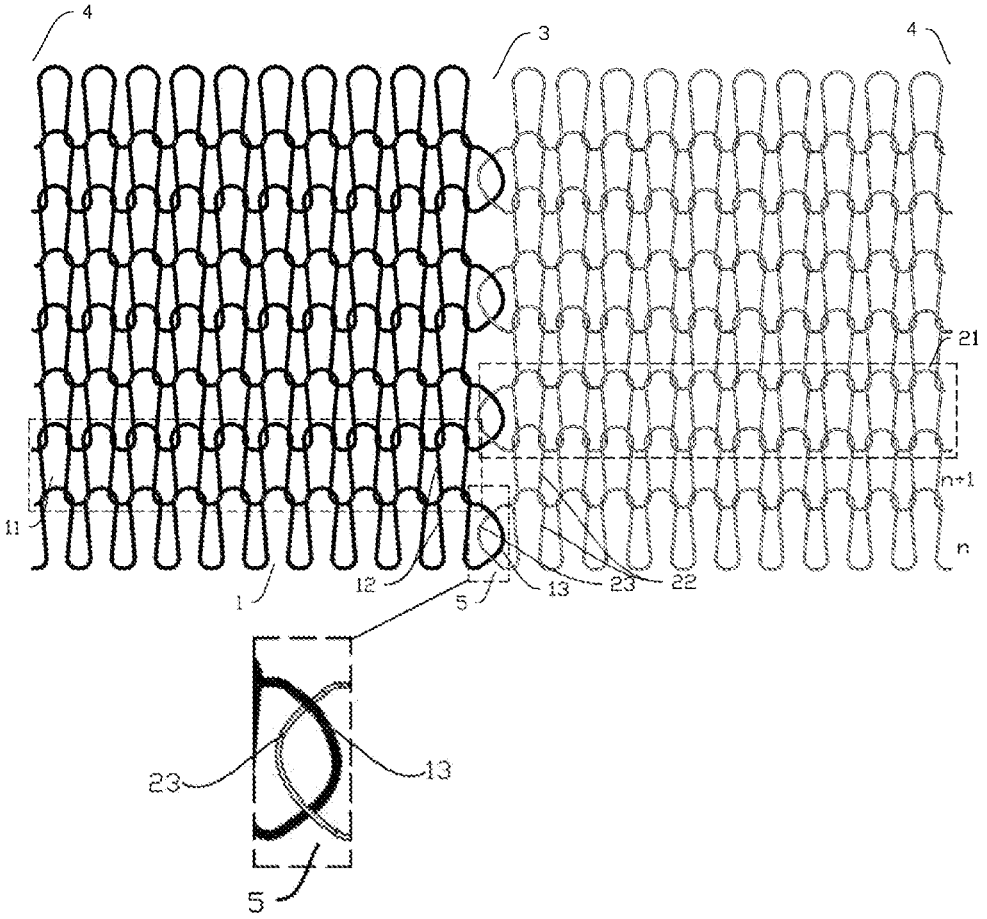
FIG. 2 is a schematic diagram of a knitted fabric of an embodiment of the present invention, wherein one side of a first face is connected with one side of a second face, and the block diagram in the drawing is an enlarged view of an interlocked part.
Figure 5:
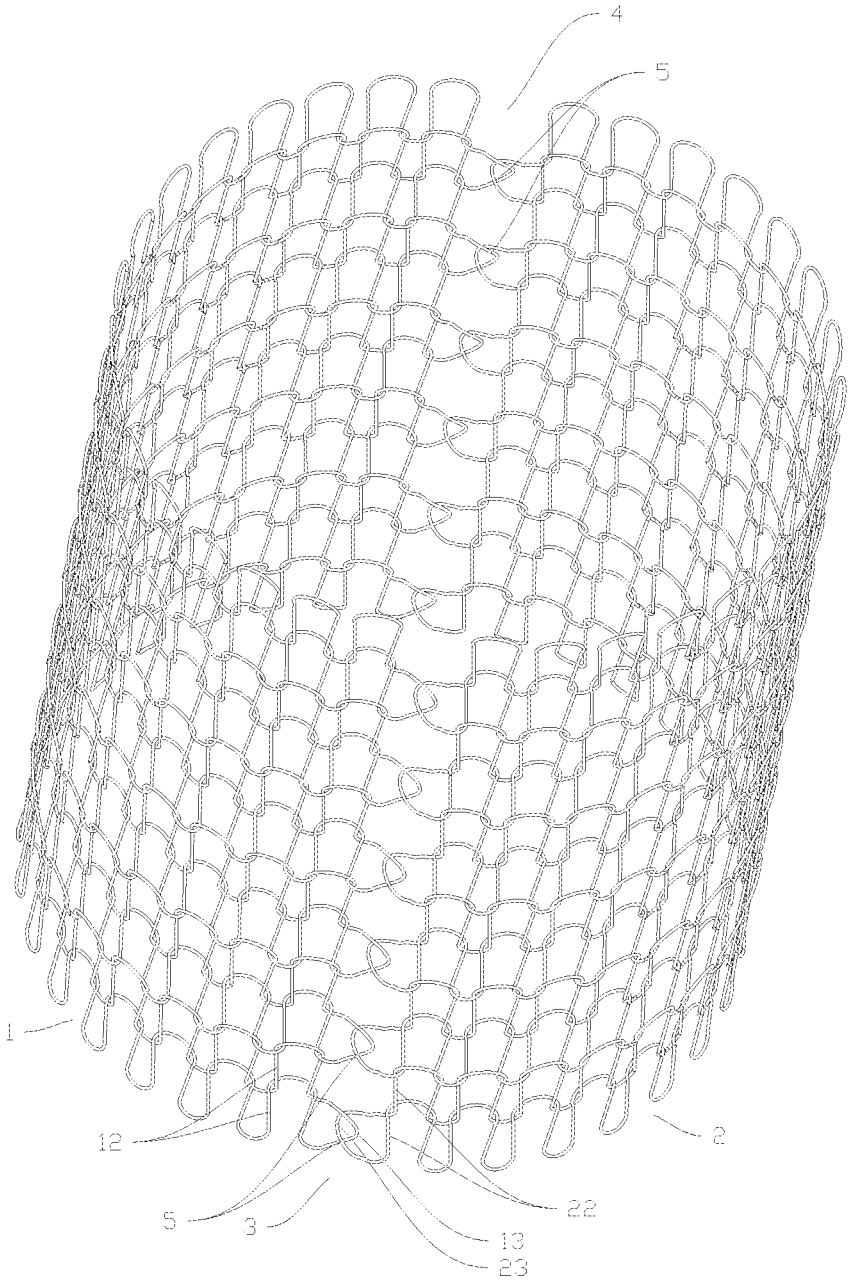
FIG. 5 is a schematic isometric view of the knitted fabric of the embodiment shown in FIG. 4

As shown in FIGS. 2 and 5, the present invention's embodiment provides a knitted fabric, including a first face 1 and a second face 2 which are oppositely arranged. It should be noted that "oppositely arranged" means that when the knitted fabric is in the knitting state, the first face 1 and the second face 2 are oppositely arranged, and after the knitting is completed, the first face 1 and the second face 2 may still maintain the oppositely-arranged state, or may be unfolded into a flat state. The first face 1 includes several first loop rows 11 connected in sequence vertically, and the first loop row 11 each includes several first loops 12 connected in sequence horizontally; and the second face 2 includes several second loop rows 21 connected in sequence vertically, and the second loop row 21 each includes several second loops 22 connected in sequence horizontally. It is worth noting that in the embodiment, the vertical direction can be a direction perpendicular to the horizontal plane or a direction not perpendicular to the horizontal plane, and the horizontal direction can be a horizontal direction or a non-horizontal direction, and the angle between the vertical direction and the horizontal direction can be a right angle, or a non-right angle.

The first face 1 and the second face 2 are independently knitted. The first face 1 and the second face 2 are knitted by different yarn feeders and the corresponding needle guide carriages respectively. At the edge joint between the first face 1 and the second face 2, a first yarn joint 13 is formed through the connection between the first loop 12 of the $n^{th}$ first loop row 11 and the first loop 12 of the $(n+1)^{th}$ first loop row 11. As shown in FIG. 2, the first yarn joint 13 is actually a part of the knitting yarns in the first face, and since the knitting yarns are soft and deformable, the shape of the first yarn joint 13 in the actual product may be different from that in FIG. 2, but the knitting yarn connected between the first loop 12 of the $n^{th}$ first loop row 11 and the first loop 12 of the $(n+1)^{th}$ first loop row 11 is deemed as the first yarn joint 13. Correspondingly, a second yarn joint 23 is formed through the connection between the second loop 22 of the $n^{th}$ second loop row 21 and the second loop 22 of the $(n+1)^{th}$ second loop row 21. As shown in FIG. 2, the second yarn joint 23 is actually a part of the knitting yarns in the second face, and since the knitting yarns are soft and deformable, the shape of the second yarn joint 23 in the actual product may be different from that in FIG. 2, but the knitting yarn connected between the second loop 22 of the $n^{th}$ second loop row 21 and the second loop 22 of the $(n+1)^{th}$ second loop row 21 is deemed as the second yarn joint 23.

Taking the first face 1 as an example, we can see that since the first yarn joint 13 is connected between the first loop 12 on the outermost side (a first side 3 or a second side 4) of the $n^{th}$ first loop row 11 and the first loop 12 on the outermost side (a first side 3 or a second side 4) of the $(n+1)^{th}$ first loop row 11, the first loop row 11 on the first face 1 is continuously knitted. Similarly, The second loop row 21 of the second face 2 is also continuously knitted. That is to say, the first face 1 and the second face 2 are independently knitted respectively, which shows that the needle guide carriages corresponding to the first face 1 and the second face 2 always knit in cooperation with the corresponding yarn feeders during the reciprocating motion with no idle motions. With such knitting method, the knitting efficiency is nearly doubled and the production capacity is substantially increased without the enhancement of the needle guide carriage's moving speed.

Figure 3:
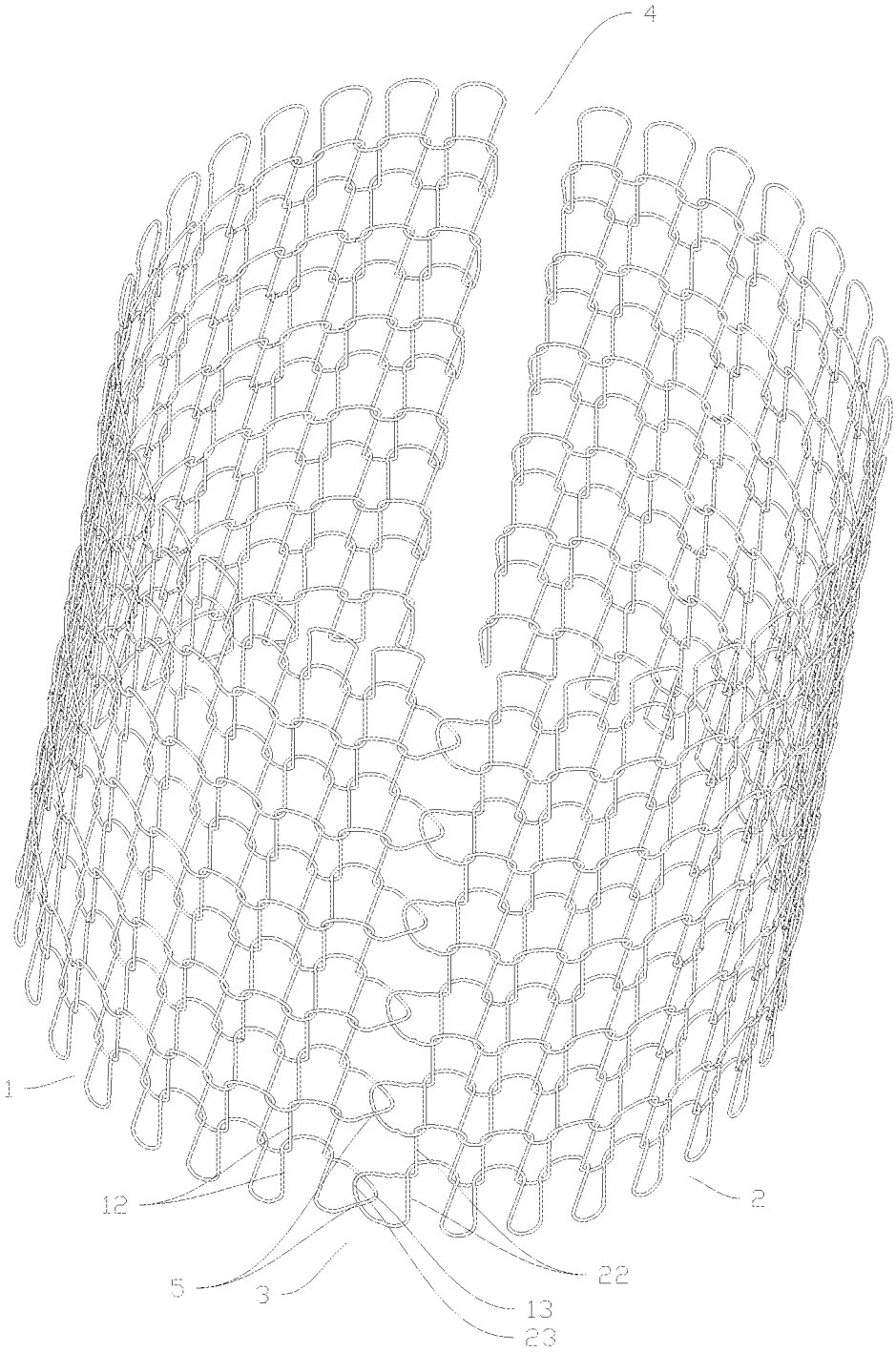
FIG. 3 is a schematic isometric view of a knitted fabric of another embodiment of the present invention.

In order to realize the connection between the first face and the second face, the first yarn joint 13 and the second yarn joint 23 interlock with each other to form an interlocked part 5 to connect the first face 1 and the second face 2. Since the first yarn joint 13 and the second yarn joint 23 are parts of the knitting yarns in the first face and the second face respectively, the interlocked part 5 is actually a structure in which two knitting yarns are interlaced together, as shown in FIG. 3. In the embodiment shown in FIG. 2, the first yarn joint 13 intersects with the second yarn joint 23 from the inside to the outside to form the interlocked part 5, and since the first yarn joint 13 is connected with the first loop 12 on the outermost side of the $n^{th}$ first loop row 11 and the first loop 12 on the outermost side of the $(n+1)^{th}$ first loop row 11, therefore, the first yarn joint 13 is in the shape of an interlocked loop. Similarly, the second yarn joint 23 which is connected with the second loop 22 on the outermost side of the $n^{th}$ second loop row 21 and the second loop 22 on the outermost side of the $(n+1)^{th}$ second loop row 21 is also in the shape of an interlocked loop. The first yarn joint 13 and the second yarn joint 23 are interlocked with each other, tightly connecting together the first face 1 and the second face 2.

In another embodiment as shown in FIG. 3, the first yarn joint 13 intersects with the second yarn joint 23 from the outside to the inside to form the interlocked part 5.

It should be noted that since the knitting yarn is deformable, after the knitting is completed, the first yarn joint 13 and the second yarn joint 23 may be relatively closer to the corresponding first loop 12 and second loop 22 respectively, so they may not necessarily present an annular shape as shown in the drawings, but they will still maintain a interlocked state.

The first face 1 and the second face 2 both have a first side 3 and a second side 4, and the first sides 3 and the second sides 4 are side edges of the first face 1 and the second face 2 along the knitting direction. Since the first face 1 and the second face 2 are opposite to each other during knitting, the first side 3 of the first face 1 is also the first side 3 of the second face 2, and the second side 4 of the first face 1 is also the second side 4 of the second face 2. If the first face 1 and the second face 2 are only connected at one side, they will only be connected through the interlocked parts 5 at the edge joint of the first sides 3 or the second sides 4, and the interlocked parts 5 are arranged at intervals in the vertical direction. In the two embodiments shown in FIGS. 2 and 3, the first face 1 and the second face 2 only have an edge joint at the first sides 3 and are connected through the interlocked parts 5. Of course, in other embodiments, the first face 1 and the second face 2 only have an edge joint at the second sides 4 and are connected through the interlocked parts 5.

Figure 4:
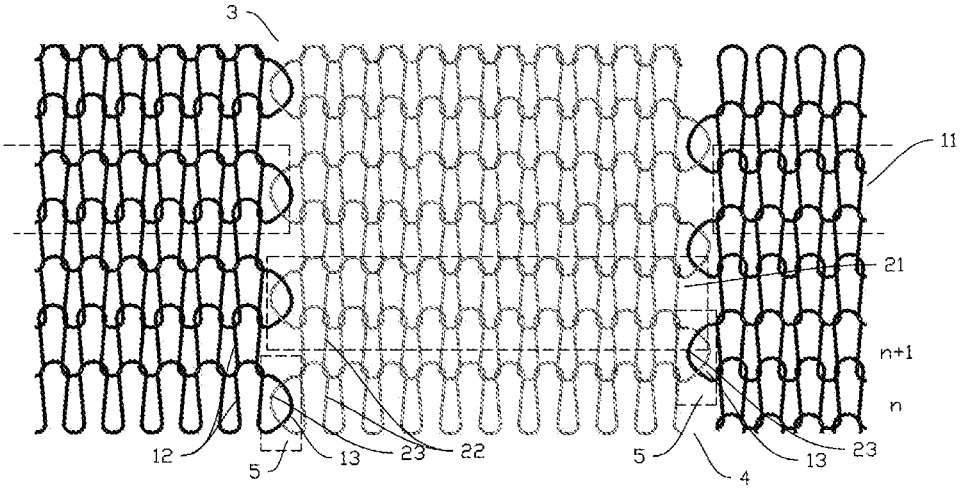
FIG. 4 is a schematic diagram of a knitted fabric of another embodiment of the present invention, wherein two sides of a first face are connected with two sides of a second face.

In another embodiment shown in FIGS. 4 and 5, a first face 1 and a second face 2 are connected at both sides, namely, the first face 1 and the second face 1 have an edge joint at both the first side 3 and the second side 4, and are connected at both sides through interlocked parts 5. The $n^{th}$ first loop row in the first face 1 and the $n^{th}$ second loop row in the second face 2 have an interlocked part 5 at the edge joint of first sides 3, and the $(n+1)^{th}$ first loop row in the first face 1 and the $(n+1)^{th}$ second loop row in the second face 2 have an interlocked part 5 at the edge joint of second sides 4; or, the $n^{th}$ first loop row in the first face 1 and the $n^{th}$ second loop row in the second face 2 have an interlocked part 5 at the edge joint of second sides 4, and the $(n+1)^{th}$ first loop row in the first face 1 and the $(n+1)^{th}$ second loop row in the second face 2 have an interlocked part 5 at the edge joint of the first sides 3.

Taking the embodiment shown in FIG. 4 as an example, we can see that the $n^{th}$ first loop row in the first face 1 and the $n^{th}$ second loop row in the second face 2 have an interlocked part 5 at the edge joint of the first sides 3, and the $(n+1)^{th}$ first loop row in the first face 1 and the $(n+1)^{th}$ second loop row in the second face 2 have an interlocked part 5 at the edge joint of the second sides 4. It should be noted that FIG. 4 is a schematic diagram of the knitted fabric after the first face 1 is split into two parts, which can show clearly that the first face 1 and the second face 2 are connected at both sides; FIG. 5 is a schematic isometric view of the knitted fabric. Specifically, at the first side 3 of the first face 1, the $n^{th}$ first loop row 11 and the $n^{th}$ second loop row 21 have an interlocked part 5; and at the second side 4 of the first face 1, the $(n+1)^{th}$ first loop row 11 and the $(n+1)^{th}$ second loop row 21 have an interlocked part 5. The $n^{th}$ row and the $(n+1)^{th}$ row constitute a knitting cycle, which is repeated in turn until the knitting for this part is completed. In the vertical direction of the first side, the interlocked parts 5 are arranged at intervals, that is, at the first side, the $n^{th}$ first loop row 11 and the $n^{th}$ second loop row 21 have an interlocked part 5, and the $(n+1)^{th}$ first loop row 11 and the $(n+1)^{th}$ second loop row 21 don't have an interlocked part 5; in the vertical direction of the second side, the interlocked parts 5 are arranged at intervals, that is, at the second side, the $n^{th}$ first loop row 11 and the $n^{th}$ second loop row 21 don't have an interlocked part 5, and the $(n+1)^{th}$ first loop row 11 and the $(n+1)^{th}$ second loop row 21 have an interlocked part 5.

In the above several embodiments, several first loop rows 11 in the first face 1 are knitted with the same yarn, and it should be noted that the same yarn refers to the yarn fed from the same yarn feeder, which can be a single yarn, or multiple yarns that are connected and fed from the same yarn feeder to participate in the knitting with the needle guide carriage. The yarn can be a single-color single yarn, and its type can be selected from any one of single-color single yarn, mono-fibre yarn, blended yarn, twisted yarn, mixed-twisted yarn, other conventional yarns, or the yarn formed by the connection of their combination.

In other embodiments, several first loop rows 11 in the first face 1 or several first loop may also be knitted with different yarns. It should be noted that different yarns here may refer to yarns of different strands, different materials, or different colors. For yarns of different materials, it means that the yarns can be selected from mono-fibre yarn, blended yarn, twisted yarn, mixed-twisted yarn, or other conventional yarns. For example, a mono-fibre yarn may be adopted for the knitting of the first few rows of the first loop row 11, and then the mono-fibre yarn may be replaced with a mixed-twisted yarn with special functions for the knitting of the next several rows of the first loop row 11, and then the mixed-twisted yarn may be replaced back with the mono-fibre yarn again for the knitting of the remaining rows of the first loop row 11. For yarns of different strands, it means that several rows of the first loop row 11 can be knitted with a two-strand yarn, that is, the two strands of yarn are fed from the two yarn feeders respectively, and knitted with the same needle guide carriage, then a first loop is knitted with the two strands of yarn together; while during the knitting of other rows or a certain row of the first loop row, one strand of yarn and its corresponding yarn feeder may not participate in the knitting, so only one strand and its corresponding yarn feeder may participate in the knitting with the needle guide carriage, then the first loops for this part are knitted with one strand of yarn. For yarns of different colors, a white yarn may be adopted for the knitting of the first few rows of the first loop row 11, and then the white yarn may be replaced with a red yarn for the knitting of the next several rows of the first loop row 1, and then the red yarn may be replaced back with the white yarn for the knitting of the remaining rows of the first loop row 11. Different yarns are fed from different yarn feeders. Under the control of the system, the different yarn feeders may participate in the knitting with the needle guide carriage at the same time or at different times, thus forming first faces of various styles.

Several first loops 12 in the first face 1 may be knitted with the same stitch, that is, all knit stitches or all purl stitches, as shown in FIGS. 2 to 5; of course, several first loops 12 in the first face 1 may also be knitted with combined stitches, such as different combinations of knit stitches and purl stitches, so as to produce various knitted fabrics.

Similarly, in the above several embodiments, several second loop rows 21 in the second face 2 are knitted with the same yarn, and it should be noted that the same yarn refers to the yarn fed from the same yarn feeder, which can be a single yarn, or multiple yarns that are connected and fed from the same yarn feeder to participate in the knitting with the needle guide carriage. The yarn can be a single-color single yarn, and its type can be selected from any one of single-color single yarn, mono-fibre yarn, blended yarn, twisted yarn, mixed-twisted yarn, other conventional yarns, or the yarn formed by the connection of their combination.

In other embodiments, several second loop rows 21 in the second face 2 or several second loop may also be knitted with different yarns. It should be noted that different yarns here may refer to yarns of different strands, different materials, or different colors. For yarns of different materials, it means that the yarns can be selected from mono-fibre yarn, blended yarn, twisted yarn, mixed-twisted yarn, or other conventional yarns. For example, a mono-fibre yarn may be adopted for the knitting of the first few rows of the second loop row 21, and then the mono-fibre yarn may be replaced with a mixed-twisted yarn with special functions for the knitting of the next several rows of the second loop row 21, and then the mixed-twisted yarn may be replaced back with the mono-fibre yarn again for the knitting of the remaining rows of the second loop row 21. For yarns of different strands, it means that several rows of the second loop row 21 can be knitted with a two-strand yarn, that is, the two strands of yarn are fed from the two yarn feeders respectively, and knitted with the same needle guide carriage, then a second loop is knitted with the two strands of yarn together; while during the knitting of other rows or a certain row of the second loop row, one strand of yarn and its corresponding yarn feeder may not participate in the knitting, so only one strand and its corresponding yarn feeder may participate in the knitting with the needle guide carriage, then the second loops for this part are knitted with one strand of yarn. For yarns of different colors, a white yarn may be adopted for the knitting of the first few rows of the second loop row 21, and then the white yarn may be replaced with a red yarn for the knitting of the next several rows of the second loop row 21, and then the red yarn may be replaced back with the white yarn for the knitting of the remaining rows of the second loop row 21. Different yarns are fed from different yarn feeders. Under the control of the system, the different yarn feeders may participate in the knitting with the needle guide carriage at the same time or at different times, thus forming second faces of various styles.

Several second loops 22 in the second face 1 may be knitted with the same stitch, that is, all knit stitches or all purl stitches, as shown in FIGS. 2 to 5; of course, several second loops 22 in the second face 2 may also be knitted with combined stitches, such as different combinations of knit stitches and purl stitches, so as to produce various knitted fabrics.

Figure 6:
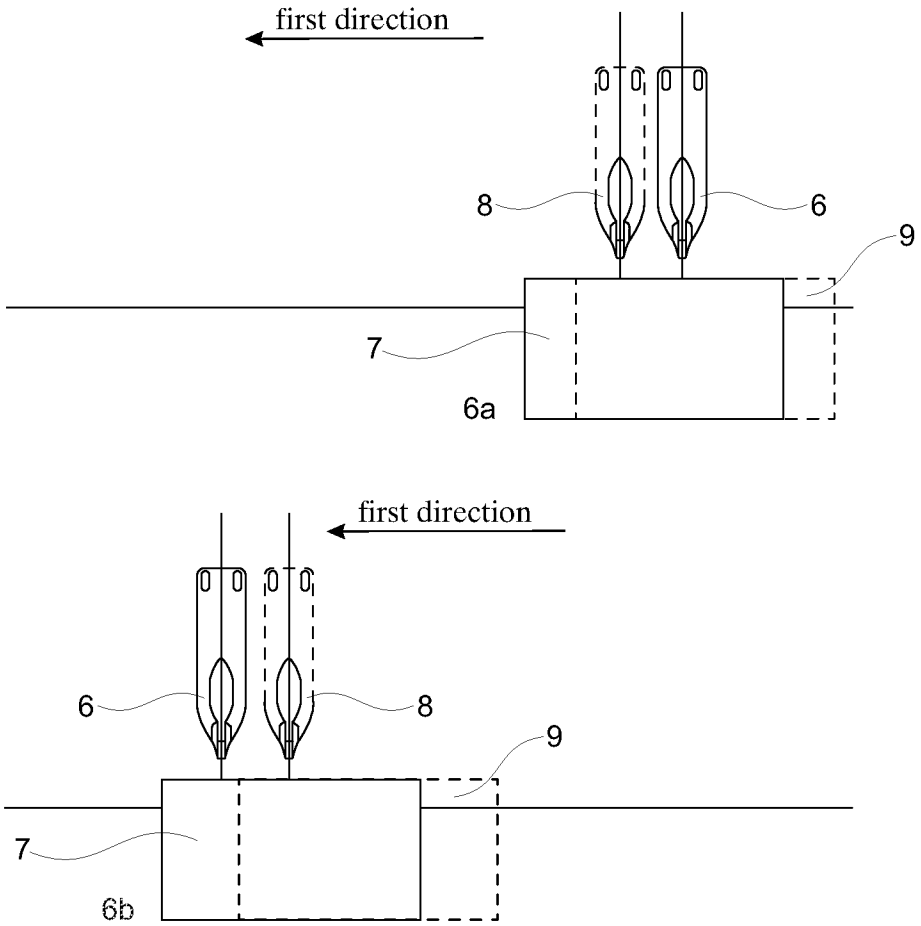
FIG. 6 is a schematic diagram of a knitting method of an embodiment of the present invention, wherein FIGS. 6*a*, 6*b*, 6*c*, and 6*d* respectively represent different positions of the yarn feeder and the needle guide carriage in a knitting cycle.
Figure 6:
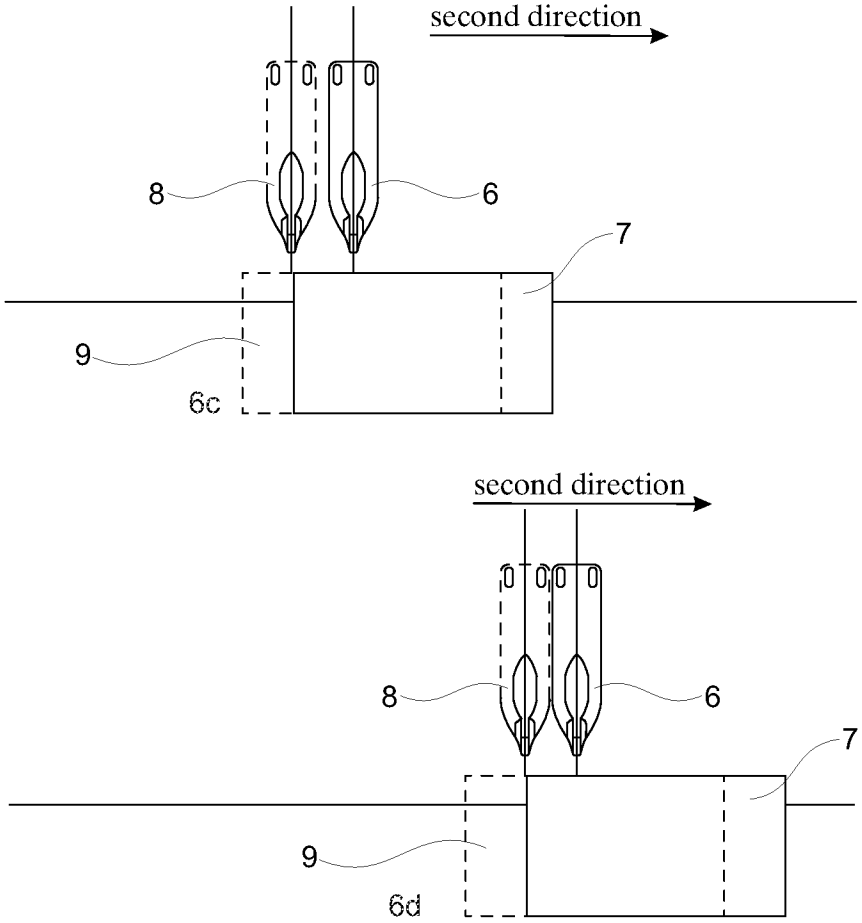
Figure 7:
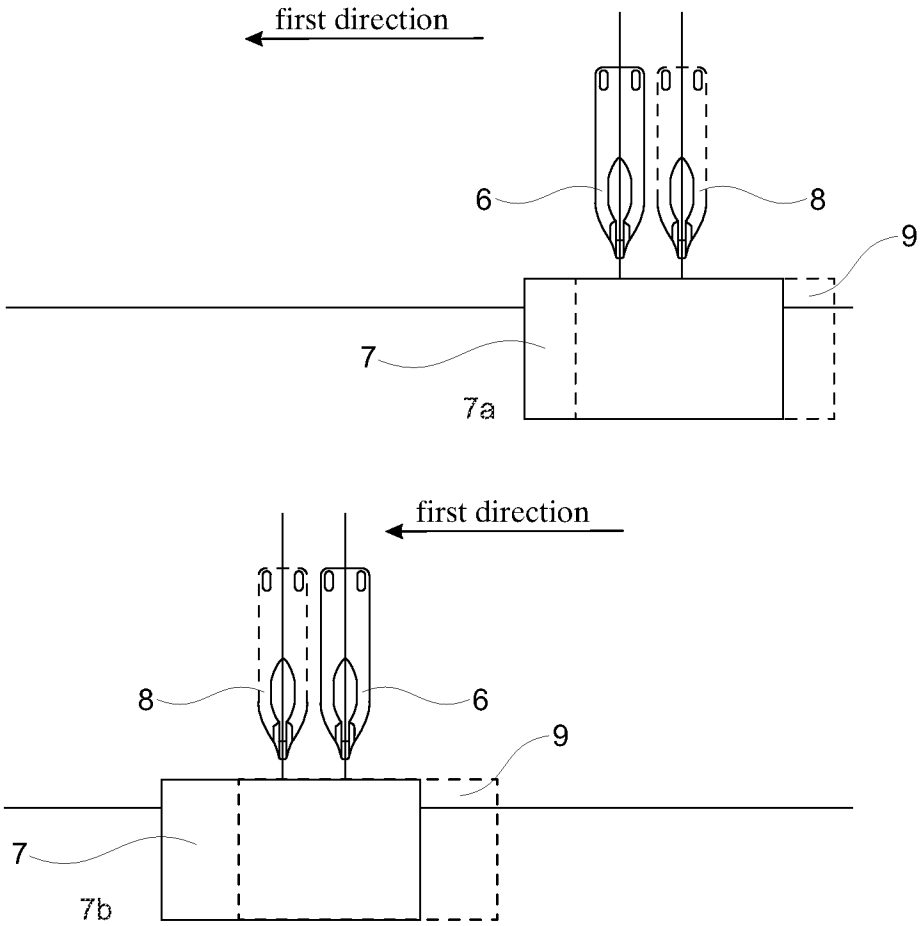
FIG. 7 is a schematic diagram of another kind of the relative positions of a first yarn feeder and a second yarn feeder in a knitting method of an embodiment of the present invention.
Figure 7:
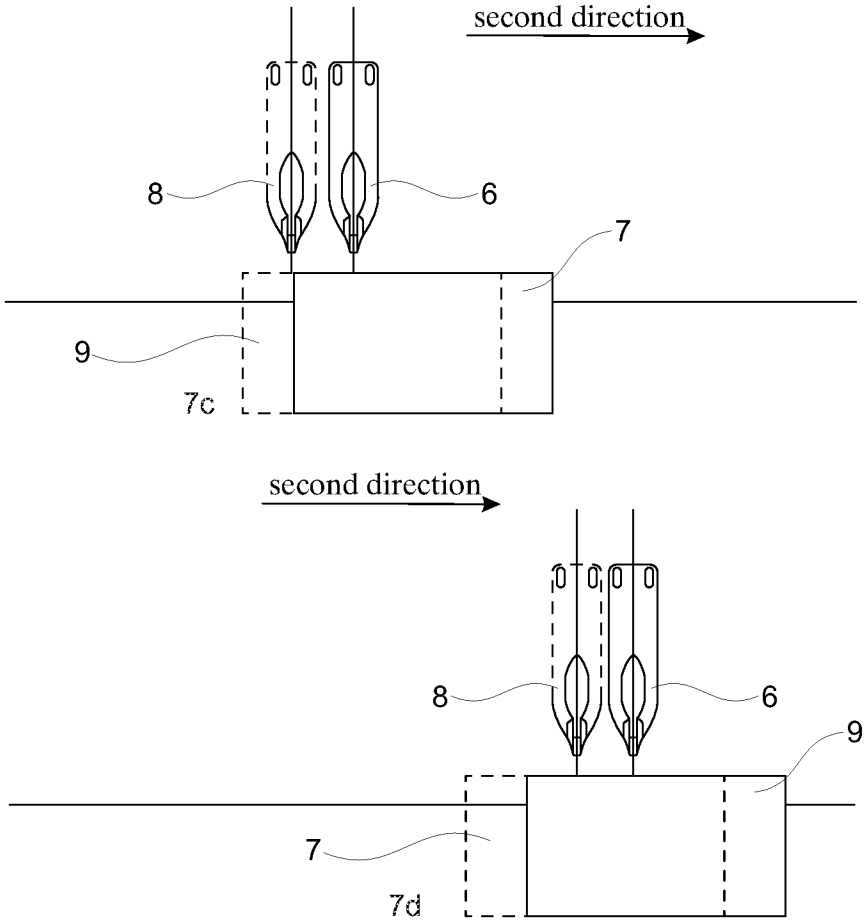

As shown in FIGS. 6 and 7, the present invention also discloses a knitting method, which is used to produce the knitted fabric of above-mentioned embodiment, wherein a first needle guide carriage and a second needle guide carriage are oppositely arranged and they can be divided into a front needle guide carriage and a back needle guide carriage. Of course, in the actual production, the first needle guide carriage may be a back needle guide carriage, and the second needle guide carriage may be a front needle guide carriage. A first needle guide carriage works together with a first yarn feeder. It should be noted that the first yarn feeder may always be the same yarn feeder during the knitting process, or may be replaced during the knitting process, or that there may be multiple yarn feeders working together with the first needle guide carriage for knitting at the same time. A yarn feeder working together with a first needle guide carriage shall be deemed as a first yarn feeder. Similarly, it should be noted that the second yarn feeder may always be the same yarn feeder during the knitting process, or may be replaced during the knitting process, or there are multiple yarn feeders working together with the second needle guide carriage for knitting at the same time. A yarn feeder working together with a second needle guide carriage shall be deemed as a second yarn feeder. As shown in FIGS. 6 and 7, the first yarn feeder 6 and the first needle guide carriage 7 represented with the solid lines move in the same direction, and the second yarn feeder 8 and the second needle guide carriage 9 represented with dotted lines move in the same direction.

The knitting method includes the following steps: as shown in FIG. 6*a*, the first direction and the second direction are both knitting directions, which are parallel with and opposite to each other. The knitting area corresponds to the number of stitches, and in the knitting area, the first yarn feeder 6 follows the first needle guide carriage 7 to move along the first direction and knit the $n^{th}$ first loop row 11 in the first face 1. The first yarn feeder 6 may move synchronously with the first needle guide carriage 7 under the control of the system, and may also move asynchronously with the first needle guide carriage 7 under a specific knitting method. Similarly, in the knitting area, the second yarn feeder 8 follows the second needle guide carriage 9 to move along the first direction and knit the $n^{th}$ second loop row 21 in the second face 2. The second yarn feeder 8 may move synchronously with the second needle guide carriage 9 under the control of the system, and may also move asynchronously with the second needle guide carriage 9 under a specific knitting method. Then, as shown in FIG. 6*b*, the first needle guide carriage 7 first reaches the edge joint of the first sides 3 of the $n^{th}$ rows of the first face 1 and the second face 2, and the second needle guide carriage 9 second reaches the edge joint of the first sides 3 of the $n^{th}$ rows of the first face 1 and the second face 2, and the second yarn feeder 8 and the first yarn feeder 6 are placed crossed to each other at the edge joint of the first sides 3 of the $n^{th}$ rows of the first face 1 and the second face 2 with the first yarn feeder 6 located at the outer side of the knitting direction of the second yarn feeder 8; then, as shown in FIG. 6*c*, the first needle guide carriage 7 first leaves the edge joint of the first sides 3 of the $n^{th}$ rows of the first face 1 and the second face 2 along the second direction, thus forming the first yarn joint 13, and the second needle guide carriage 9 second leaves the edge joint of the first sides 3 of the $n^{th}$ rows of the first face 1 and the second face 2 along the second direction, thus forming the second yarn joint 23. Since the first needle guide carriage 7 reaches the first side 3 earlier than the second needle guide carriage 9, and also leaves the first side 3 earlier than the second needle guide carriage 9, the first yarn joint 13 and the second yarn joint 23 interlock with each other at the edge joint of the first sides 3 of the first face 1 and the second face 2. After the knitting for the $(n+1)^{th}$ first loop row and the $(n+1)^{th}$ second loop row starts, the interlocked first yarn joint 13 and second yarn joint 23 will form an interlocked loop respectively, further forming an interlocked part 5 that connects the first face 1 and the second face 2. It should be noted that the first yarn feeder 6 corresponds to the first needle guide carriage 7, that the second yarn feeder 8 corresponds to the second needle guide carriage 9, and that at the first side 3 and the second side 4, the first yarn feeder 6 and the second yarn feeder 8 may be oppositely arranged, or may be placed crossed to each other, and the first yarn feeder 6 may also be located outside the second yarn feeder 8, as shown in FIG. 6, and the first yarn feeder 6 may also be located inside the second yarn feeder 8 as shown in FIG. 7. The first yarn feeder 6 only needs to maintain the corresponding relationship with the first needle guide carriage, and it works the same for the second yarn feeder 8 and the second needle guide carriage.

If the first face 1 and the second face 2 are only connected at one side, for example, they are only connected and have edge joints at the first sides 3, then the first yarn feeder 6 and the first needle guide carriage 7 first move to the second side 4, and the second yarn feeder 8 and the second needle guide carriage 9 second move to the second side 4, and then the second yarn feeder 8 and the second needle guide carriage 9 first leave along the first direction, and the first yarn feeder 6 and the first needle guide carriage 7 second leave along the first direction, thus, the first yarn joint 13 and the second yarn joint 23 don't interlock with each other at the edge contacting area of the second sides 4 of the first face 1 and the second face 2, that is, no interlocked part 5 is formed, and the first face 1 and the second face 2 are not connected at the edges of the second sides 4. Then, the first yarn feeder 6, the first needle guide carriage 7, the second yarn feeder 8 and the second needle guide carriage 9 reciprocate in the first direction and the second direction according to the above knitting method, and continue knitting until the knitting is completed. The $n^{th}$ row and the $(n+1)^{th}$ row constitute a knitting cycle. There is an interlocked part 5 at the first sides 3 of the $n^{th}$ rows, and the interlocked parts are perpendicular to the knitting direction and are distributed at intervals, and there is no interlocked part 5 at the first sides 3 of the $(n+1)^{th}$ rows, $n \geq 1$.

In the actual product, the first side 3 may be the left side of the folded-like knitted fabric, and the second side 4 may be the right side of the folded-like knitted fabric; or, the first side 3 may be the right side of the folded-like knitted fabric, and the second side 4 may be the left side of the folded-like knitted fabric; or, the first side 3 may be the upper side of the folded-like knitted fabric, and the second side 4 may be the lower side of the folded-like knitted fabric; or, the first side 3 may be the lower side of the folded-like knitted fabric, and the second side 4 may be the upper side of the folded-like knitted fabric; in short, the first side 3 and the second side 4 are two opposite sides of a knitted fabric. Folded-like knitted fabric refers to a knitted fabric whose first face and second face are opposite to and match with each other.

If the first face 1 and the second face 2 are connected at both sides, which means they are connected both at the first sides 3 and the second sides 4, then as shown in FIG. 6*a*, the first direction and the second direction are both knitting directions, which are parallel with and opposite to each other, and the knitting area corresponds to the number of stitches, and in the knitting area, the first yarn feeder 6 follows the first needle guide carriage 7 to move along the first direction and knit the $n^{th}$ first loop row 11 in the first face 1, and the first yarn feeder 6 may move synchronously with the first needle guide carriage 7 under the control of the system, and may also move asynchronously with the first needle guide carriage 7 under a specific knitting method; similarly, in the knitting area, the second yarn feeder 8 follows the second needle guide carriage 9 to move along the first direction and knit the $n^{th}$ second loop row 21 in the second face 2, and the second yarn feeder 8 may move synchronously with the second needle guide carriage 9 under the control of the system, and may also move asynchronously with the second needle guide carriage 9 under a specific knitting method; then, as shown in FIG. 6*b*, the first needle guide carriage 7 first reaches the edge joint of the first sides 3 of the $n^{th}$ rows of the first face 1 and the second face 2, and the second needle guide carriage 9 second reaches the edge joint of the first sides 3 of the $n^{th}$ rows of the first face 1 and the second face 2, and the second yarn feeder 8 and the first yarn feeder 6 are placed crossed to each other at the edge joint of the first sides 3 of the $n^{th}$ rows of the first face 1 and the second face 2 with the first yarn feeder 6 located at the outer side of the knitting direction of the second yarn feeder 8; then, as shown in FIG. 6*c*, the first needle guide carriage 7 first leaves the edge joint of the first sides 3 of the $n^{th}$ rows of the first face 1 and the second face 2 along the second direction, thus forming a first yarn joint 13, and the second needle guide carriage 9 second leaves the edge joint of the first sides 3 of the $n^{th}$ rows of the first face 1 and the second face 2 along the second direction, thus forming a second yarn joint 23, and since the first needle guide carriage 7 reaches the first side 3 earlier than the second needle guide carriage 9, and also leaves the first side 3 earlier than the second needle guide carriage 9, the first yarn joint 13 and the second yarn joint 23 interlock with each other at the edge joint of the first sides 3 of the first face 1 and the second face 2, and after the knitting for the $(n+1)^{th}$ first loop row and the $(n+1)^{th}$ second loop row starts, the interlocked first yarn joint 13 and second yarn joint 23 form an interlocked loop respectively, further forming an interlocked part 5 that connects the first face 1 and the second face 2; and then, the first yarn feeder and the first needle guide carriage knit the $(n+1)^{th}$ first loop row, and the second yarn feeder and the second needle guide carriage knit the $(n+1)^{th}$ second loop row; as shown in FIG. 6*d*, the first needle guide carriage 7 first reaches the edge joint of the second sides 4 of the $(n+1)^{th}$ rows of the first face 1 and the second face 2, and the second needle guide carriage 9 second reaches the edge joint of the second sides 4 of the $(n+1)^{th}$ rows of the first face 1 and the second face 2, and the second yarn feeder 8 and the first yarn feeder 6 are placed crossed to each other at the edge joint of the second sides t of the $(n+1)^{th}$ rows of the first face 1 and the second face 2 with the first yarn feeder 6 located at the outer side of the knitting direction of the second yarn feeder 8, and then, as shown in FIG. 6*a*, the first needle guide carriage 7 first leaves the edge joint of the second sides 4 of the $(n+1)^{th}$ rows of the first face 1 and the second face 2 along the first direction, and the second needle guide carriage 9 second leaves the edge joint of first face 1 and the second face 2 along the first direction, and the first yarn joint 13 and the second yarn joint 23 interlock with each other at the edge joint of the second sides 4 of the first face 1 and the second face 2, and after the knitting of the next row starts, the interlocked first yarn joint 13 and second yarn joint 23 form an interlocked loop respectively, further forming an interlocked part 5 that connects the first face 1 and the second face 2 at the second sides 4. The $n^{th}$ row and the $(n+1)^{th}$ row constitute a knitting cycle, $n \geq 1$, and the interlocked parts 5 are perpendicular to the knitting direction and are distributed at intervals. There is an interlocked part 5 at the first sides 3 of the $n^{th}$ rows, and there is no interlocked part 5 at the first sides 3 of the $(n+1)^{th}$ rows, and there is an interlocked part 5 at the second sides 4 of the $(n+1)^{th}$ rows, and there is no interlocked part 5 at the second sides 4 of the $n^{th}$ rows, thereby, the connections of the face 1 and the face 2 at two sides are realized.

The knitted fabric of the present invention can be wearable items such as gloves, sweaters, knitted scarves, etc., and can also be a part of the above-mentioned wearable items.

Figure 8:
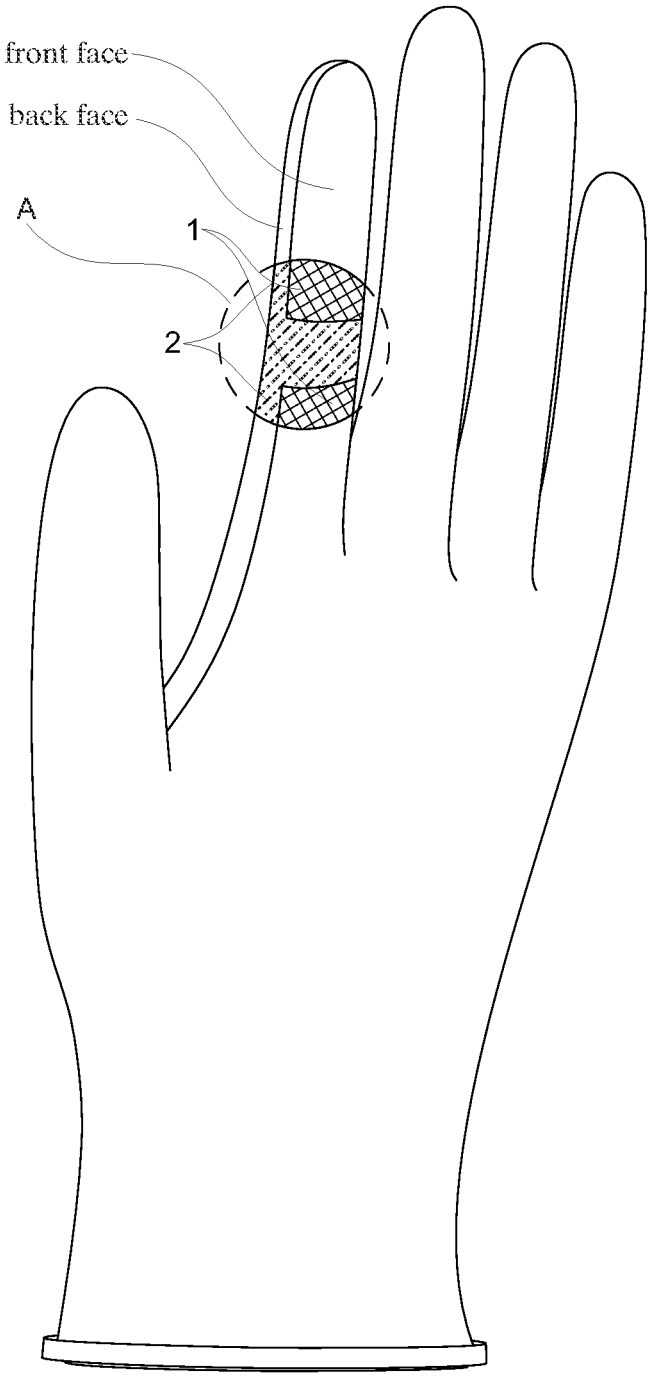
FIG. 8 is a schematic diagram of a glove of an embodiment of the present invention, wherein the knitted fabric of an embodiment of the present invention is a part of the glove.
Figure 9:
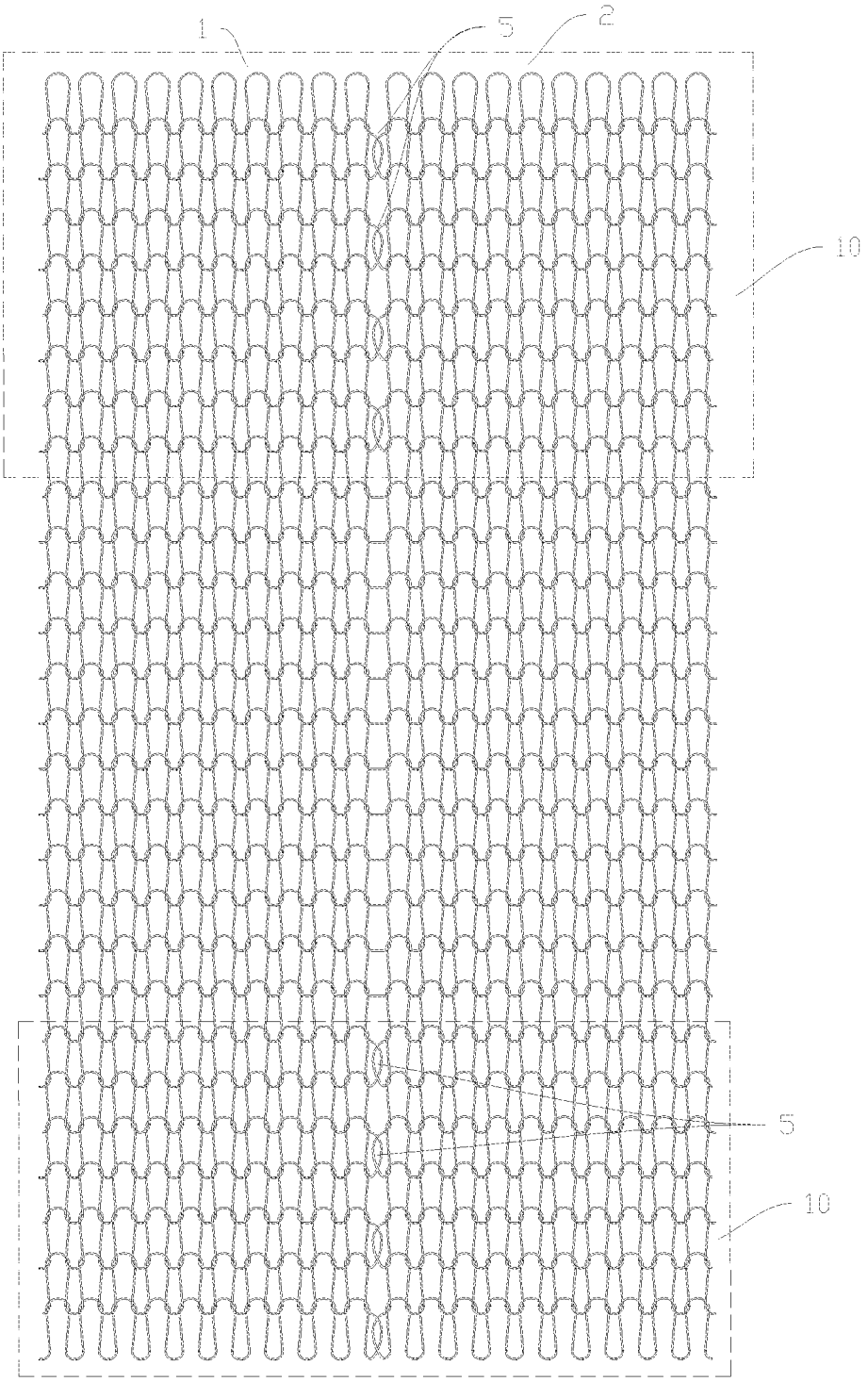
FIG. 9 is an enlarged view of a localized detail at A of the glove in FIG. 8.

The present invention also discloses a glove, which has the knitted fabric in the above embodiment. In one embodiment of the glove, the overall structure of the glove may also be the knitted fabric 10 of the above embodiment, and the front face of the glove is the first face 1 of the knitted fabric, and the back face is the second face 2 of the knitted fabric, and the edges of the two sides of the entire glove are all connected through interlocked parts 5, so that the two faces of the glove are connected into a whole;

In another embodiment of the glove, during the knitting process of the glove, the knitting method of the above-mentioned embodiment can be combined with the knitting method of the prior art, and the knitted fabric 10 of the embodiment can be part of the glove thus obtained, which means, in the front face and back face of the complete glove, part of the front face is the first face 1 of the embodiment, and part of the back face is the second face 2 of the embodiment, and the front face and back face of such parts are connected through interlocked parts 5 at the edges of both sides; other parts of the glove can be knitted in the conventional spiral manner with no interlocked parts at the edges of both sides for the front face and back face, as shown in FIGS. 8 and 9.

The above-mentioned embodiments are only preferred embodiments of the present invention, and cannot be used to limit the protection scope of the present invention. Any insubstantial changes and substitutions made by those skilled in the art on the basis of the present invention belong to the protection scope claimed by the present invention.

What is claimed is:

1. A knitted fabric, comprising a first face and a second face which are oppositely arranged, wherein the first face comprises several first loop rows connected in sequence vertically, and the first loop rows each comprise several first loops connected in sequence horizontally; and the second face comprises several second loop rows connected in sequence vertically, and the second loop rows each comprise several second loops connected in sequence horizontally;

wherein a first edge joint is formed between a first side of the first face and a first side of the second face, and a second edge joint is formed between a second side of the first face and a second side of the second face;

wherein at the first edge joint, a first interlocked part is formed between the first side of a $n^{th}$ first loop row of the first face and the first side of a $n^{th}$ second loop row of the second face; at the second edge joint, a second interlocked part is formed between the second side of a $(n+1)^{th}$ first loop row of the first face and the second side of a $(n+1)^{th}$ second loop row of the second face; in a vertical direction of the first edge joint, several first interlocked parts are arranged at intervals; and in a vertical direction of the second edge joint, several second interlocked parts are arranged at intervals; or wherein at the first edge joint, a first interlocked part is formed between the first side of a $(n+1)^{th}$ first loop row of the first face and the first side of a $(n+1)^{th}$ second loop row of the second face; at the second edge joint, a second interlocked part is formed between the second side of a $n^{th}$ first loop row of the first face and the second side of a $n^{th}$ second loop row of the second face; in the vertical direction of the first edge joint, several first interlocked parts are arranged at intervals; and in the vertical direction of the second edge joint, several second interlocked parts are arranged at intervals; and wherein n is an integer denoting a row number of the knitted fabric.

2. The knitted fabric of claim 1, wherein the several first loop rows in the first face are knitted with a same yarn.

3. The knitted fabric of claim 1, wherein the several first loop rows in the first face are knitted with different yarns.

4. The knitted fabric of claim 1, wherein the several second loop rows in the second face are knitted with a same yarn.

5. The knitted fabric of claim 1, wherein the several second loop rows in the second face are knitted with different yarns.

6. A knitting method for the knitted fabric claim 1, wherein, in a knitting area, a first yarn feeder follows a first needle guide carriage to move along a first direction and knit the $n^{th}$ first loop row in the first face, and a second yarn feeder follows a second needle guide carriage to move along the first direction and knit the $n^{th}$ second loop row in the second face, and the first needle guide carriage first reaches the first edge joint of the first sides of the $n^{th}$ rows of the first face and the second face, and the second needle guide carriage second reaches the first edge joint of the first sides of the $n^{th}$ rows of the first face and the second face; and then, the first needle guide carriage first leaves the first edge joint of the first sides of the $n^{th}$ rows of the first face and the second face along a second direction, and the second needle guide carriage second leaves the first edge joint of the first sides of the $n^{th}$ rows of the first face and the second face along the second direction, and the $n^{th}$ first loop row and the $n^{th}$ second loop row interlock with each other at the first edge joint of the first sides of the first face and the second face to form the several first interlocked parts, thus connecting the first face and the second face; and then, the first yarn feeder follows the first needle guide carriage along the second direction to knit the $(n+1)^{th}$ first loop row in the first face, and the second yarn feeder follows the second needle guide carriage along the second direction to knit the $(n+1)^{th}$ second loop row in the second face; and the first direction and the second direction are parallel with and opposite to each other; the first face and the second face are connected at both the edge joints of the first sides and the second sides; and the first needle guide carriage first reaches the second edge joint of the second sides of the $(n+1)^{th}$ rows of the first face and the second face, and the second needle guide carriage second reaches the second edge joint of the second sides of the $(n+1)^{th}$ rows of the first face and the second face; and then, the first needle guide carriage first leaves the second edge joint of the second sides of the $(n+1)^{th}$ rows of the first face and the second face along the first direction, and the second needle guide carriage second leaves the second edge joint of the second sides of the $(n+1)^{th}$ rows of the first face and the second face along the first direction, and the $(n+1)^{th}$ first loop row and the $(n+1)^{th}$ second loop row interlock with each other at the second edge joint of the second sides of the first face and the second face to form the several second interlocked parts.

7. A glove comprising the knitted fabric of claim 1.

* * * * *